United States Patent [19]

Stavrou et al.

[11] 4,099,437

[45] Jul. 11, 1978

[54] REMOTE CONTROL WIRELESS KEYBOARD MUSICAL INSTRUMENT

[75] Inventors: Paul Constantine Stavrou, Allentown, Pa.; William Frederick Slack, Byram Township, Sussex County, N.J.

[73] Assignee: Jerry L. Noury, Jr., New York, N.Y.

[21] Appl. No.: 751,595

[22] Filed: Dec. 17, 1976

[51] Int. Cl.[2] ..... G10H 1/00

[52] U.S. Cl. ..... 84/1.01; 84/1.03; 84/423; 84/424; 84/462; 84/17

[58] Field of Search ..... 84/1.01, 1.03, 1.07, 84/1.13, 1.15, 1.16, 1.24, 13, 17, 462, 423, 424, DIG. 7; 340/146.1 AG; 179/41 A, 15 BZ, 15 R

[56] References Cited

U.S. PATENT DOCUMENTS

| | | | |
|---|---|---|---|
| 3,085,460 | 4/1963 | Edwards | 84/1.16 X |
| 3,531,631 | 9/1970 | Burgess | 340/146.1 AC X |
| 3,541,912 | 11/1970 | Radke | 84/1.17 |
| 3,604,299 | 9/1971 | Englund | 84/1.17 X |
| 3,705,948 | 12/1972 | Tomisawa | 84/1.24 |
| 3,899,951 | 8/1975 | Griffith et al. | 84/1.03 X |
| 3,969,968 | 7/1976 | Clark, Jr. et al. | 84/1.24 X |

*Primary Examiner*—Ulysses Weldon
*Attorney, Agent, or Firm*—Arthur L. Lessler

[57] ABSTRACT

A musical instrument which comprises (i) a portable transmitter unit, (ii) a receiver unit, and (iii) a standard or modified piano, electronic organ, or other keyboard musical device. The transmitter unit has sixty keys, each of which corresponds to a key of the remote piano, organ, or other keyboard musical device, and also has eight auxiliary switches for controlling the receiver and auxiliary functions of the musical device to be remotely played. The transmitter includes electronic circuitry which scans the keys and auxiliary switches, and transmits an FM signal modulated by a serial digital pulse train identifying the transmitter keys which are depressed and the auxiliary switches which have been actuated. The receiver unit decodes the transmitted pulse train, eliminates erroneous data, and generates output signals to control the corresponding keys and auxiliary functions. The transmitter circuitry contains means for incorporating features in the digital code utilized which provide increased noise immunity and alleviate the need for the receiver to handle very low frequencies of the demodulated signal.

31 Claims, 7 Drawing Figures

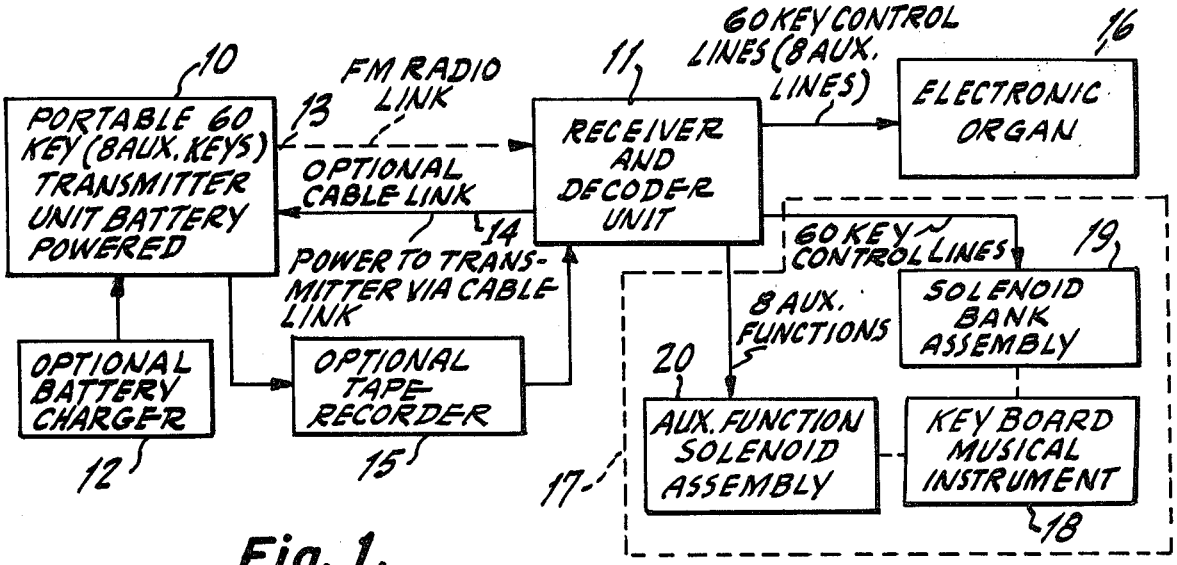
Fig. 1.
Fig. 2.
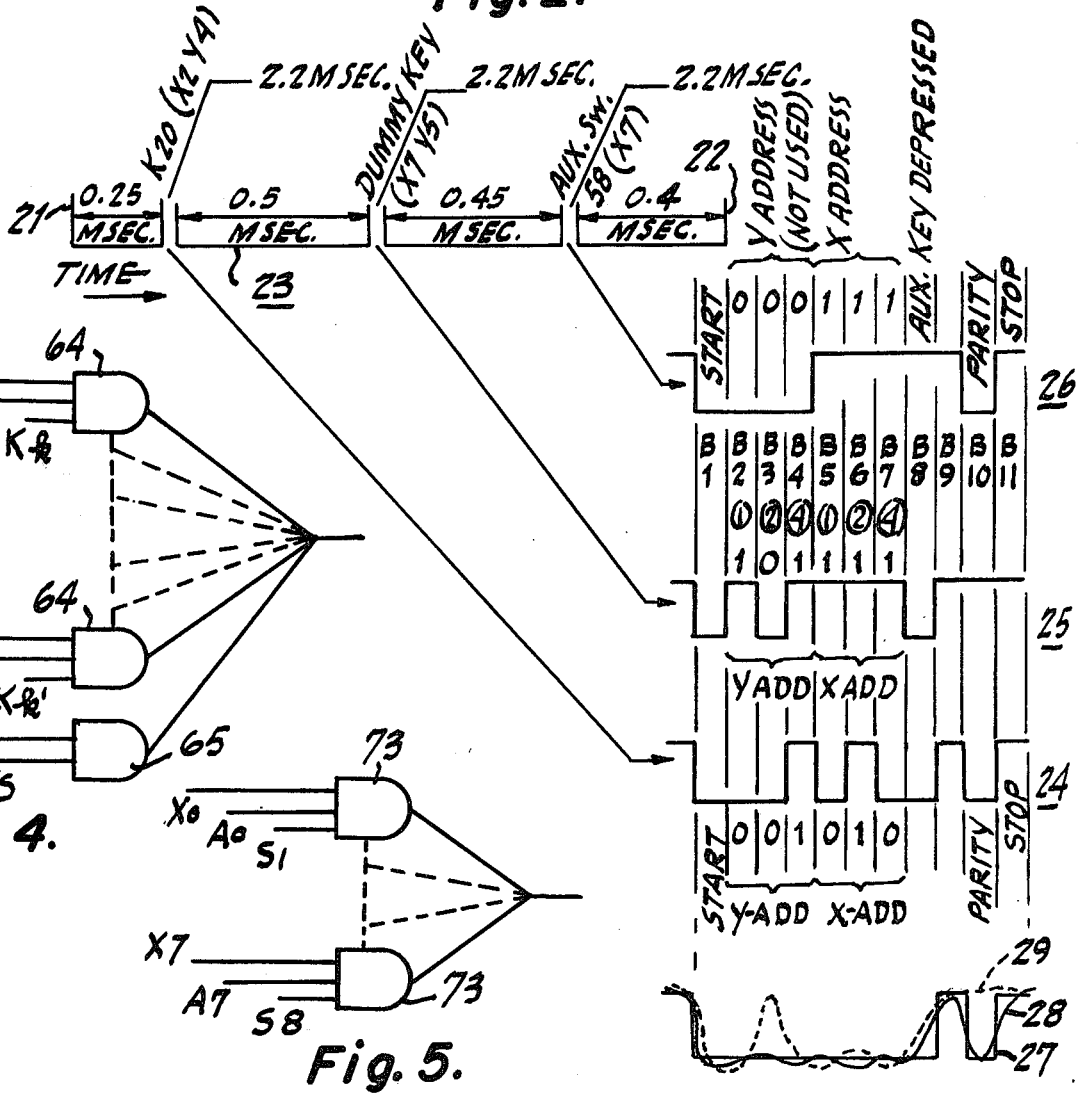
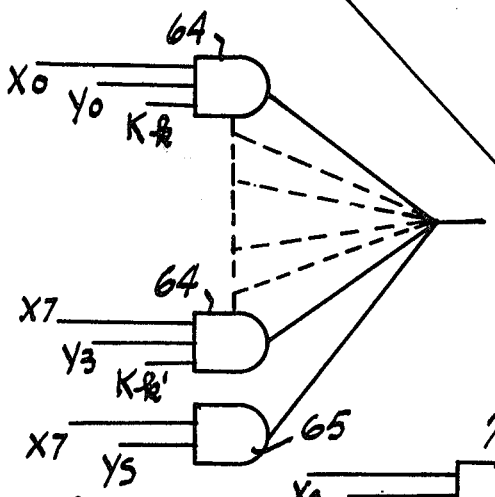
Fig. 4.
Fig. 5.

REMOTE CONTROL WIRELESS KEYBOARD MUSICAL INSTRUMENT

BACKGROUND OF THE INVENTION

This invention relates to a remote control wireless keyboard musical instrument, and more particularly to a musical system including a portable transmitter having keys, a remote receiver, and a musical device coupled to the receiver for generating musical sounds when corresonding keys of the transmitter are actuated.

In recent years much work has been done in the field of electronic musical instruments, with the object of (i) creating new musical instruments capable of producing unique musical sounds, and (ii) improving the operation or simplifying the construction of existing musical instruments.

There is a need, however, for a musical system which enables a performer to move freely about while playing a musical composition. With the advent of increased interaction between performers and their audiences, there has been a greater tendency for many performers to leave the stage at times and to move through the audience, speaking to individual persons in the audience and playing musical selections for them. This trend has been accelerated by the advent of wireless microphones, which eliminate the restriction of movement caused by the microphone cable between a performer and his remote amplifier unit.

This method of entertainment, in which a performer moves through an audience and plays musical selections as he moves about, has heretofore been limited to the use of musical devices which were relatively light in weight and sufficiently small in bulk to be portable. Typical devices used by performers moving about in their audiences might be accordians, quitars, violins, small wind instruments, etc.

Because of the obvious size and weight limitations of the musical equipment which a performer can carry as he moves through an audience, it is not possible for such a performer to play relatively bulky and heavy musical devices which produce more impressive, desirable, or preferred sounds, such as pianos or organs. Thus there is a need for a musical system whereby a performer may carry a relatively light weight, relatively small remote control unit as he moves through an audience or otherwise moves about, and thereby control the operation of a remote musical device, e.g. a keyboard musical instrument such as a piano or organ. Preferably, such a system should employ a wireless communication link between the portable control unit and the remote portions thereof, to eliminate the need for a cumbersome and restrictive cable connection between the same.

Although systems have been devised for the automatic or remote control of keyboard musical instruments by means of wire data links between the control source and the musical device being played, there has been little or no attention given by practitioners of the electronic musical instrument art to the wireless control of musical devices in general and keyboard musical devices such as pianos and organs in particular.

For example, the automatic playing of pianos has been a well developed art for over fifty years, the most well known examples of this art being player pianos controlled by perforated paper rolls. In the player piano art there is also known an accessory unit, such as that of U.S. Pat. No. 1,109,554, which can be detachably secured to a piano above the keys thereof, to automatically depress predetermined keys, by means of electrically controlled solenoid devices. U.S. Pat. No. 883,252 shows a bracket arrangement for detachably mounting a piano action, i.e. a playing device to be disposed immediately above the piano keyboard, with facilities for adjusting the bracket position to align the piano action with the underlying piano keyboard keys. These patents are hereby incorporated into this application by reference thereto, to the extent they disclose features applicable to embodiments of the invention herein described.

U.S. Pat. No. 3,709,085 shows a teaching device in which a remote keyboard is provided which is coupled by wires to an elongated housing disposed above the keyboard of a keyboard musical instrument. The housing includes a plurality of solenoids, one solenoid being positioned above each key of the musical instrument to be played, so that in one mode of operation a teacher can play the remote keyboard and the corresponding keys of the keyboard musical device will be depressed by the remotely controlled solenoids mounted within the elongated housing positioned over the instrument keyboard. See in particular FIG. 15 of this patent and the corresponding description at column 6, lines 38 to 65. To the extent it is applicable to embodiments of the invention herein described, the disclosure of this patent is incorporated herein by reference thereto.

U.S. Pat. No. 3,388,206 shows a guitar which includes a number of switches mounted by its fingerboard for controlling a remote organ through wires.

U.S. Pat. No. 3,610,802 shows an accordian-organ in which the organ electronics and speaker are located in a remote unit connected to the accordian-organ control units by wires.

U.S. Pat. No. 3,825,666 shows a system in which a guitar includes the equivalent of a wireless microphone, i.e. the audio output of the guitar is transduced and radiated to a remote receiver, the output of which drives a speaker. Only the audio signal generated by the guitar is transmitted. There is no transmission of data corresonding to discrete keys, functions, or desired musical sounds.

The use of multiplex techniques and computer storage and retrieval techniques in conjunction with electronic organs is well known in the art. For example, U.S. Pat. No. 3,905,267 shows an arrangement for utilizing multiplex techniques to transform the key depressions of an organ (corresonding to a musical composition being played on the organ) into a digital code. The code is then recorded on a tape recorder, for later playback through a decoder which drives solenoids to depress the organ keys to replay the original composition.

U.S. Pat. Nos. 3,915,047 and 3,926,088 describe arrangements in which an organ is electronically coupled to a computer by wires and the organs keys being depressed during a performance are converted into digital data which is stored or analyzed by the computer. U.S. Pat. No. 3,926,088 referred to above also shows a computer scheme for displaying the music in musical notation as it is played by the performer.

U.S. Pat. No. 3,968,716 shows a keyboard instrument employing multiplex transmission by wires from the keyboard to remote tone generators (multiplex is employed to reduce the number of wires needed), and wireless transmission of the audio information from the tone generators to remote speakers. Like U.S. Pat. No. 3,825,666, this system does not employ wireless transmission of data corresponding to particular keys or musical sounds to be reproduced.

Multiplex schemes for multiplexing the information as to which keys are being depressed during a performance on an organ are also described in U.S. Pat. Nos. 3,875,842, 3,899,951 and 3,916,750, none of which employ wireless transmission of data.

Of the three patents mentioned in the preceding paragraph, U.S. Pat. No. 3,899,951 employs an asynchronous organ key scanning arrangement which is similar in principle to the portable transmitter key scanning arrangement employed in the embodiment of the instant invention hereafter described; however, as will become apparent upon studying the detailed description of said embodiment which follows, there are differences in implementation between said patent and the aforementioned embodiment.

Like the multiplex schemes mentioned above in connection with prior art patents, the invention herein described utilizes multiplex techniques to convert the key depressions of a keyboard made during a performance into a digital code. However, in addition to the many other differences between the instant invention and prior art, an important feature of the invention is the transmission of the digital code to a remote receiving unit by wireless rather than through wires, as is done in the prior art multiplexing schemes referred to above.

Although at first blush it might seem obvious to substitute wireless transmission for transmission through wires simply by modulating a suitable carrier wave with a digital information to be transmitted, and demodulating the same at a receiver, this does not prove to be the case when a practical system is to be constructed for transmitting data corresponding to musical notes or sounds, or other musical functions.

The reason for this difference in design considerations between conventional transmission of multiplexed musical data through wires, and wireless transmission of the same, is twofold.

First, while DC signals and levels can be readily transmitted through wires, DC transmission is inherently nonexistent in wireless transmission, which by its nature permits only of the radiation of AC signals. This is an important limitation, since in order to accurately decode a digital signal of the type normally employed, it is necessary to establish a DC reference level for the decoding equipment. This absence of DC transmission capability is accompanied by the need for the receiver to have a very good low frequency response, so as to minimize the DC reference problem referred to above; unfortunately, such low frequency response can only be obtained at the expense of additional complexity and cost of the receiver, sometimes also at the expense of poor recovery characteristics from high level noise impulses, which may "paralyse" the receiver momentarily.

Another serious problem encountered in wireless transmission of musical data and not normally present to a significant degree in systems employing transmission by wires, is susceptibility to noise in general, and impulse noise in particular. One might conclude that such noise considerations should not be a problem because of the relatively short distances involved in transmission between a performer while moving about his audience, and a remote receiver which might be located on or near the stage. However, it has been discovered in actual field trails that noise interference is a factor which is particularly significant in remote control wireless music systems of the type to which the instant invention is directed. This is so for two principal reasons.

One reason that noise considerations are significant in spite of the relatively short transmission distances involved, is the limitation on the power that may be transmitted. For a wireless system to be practicable on a marketing basis, it is essential that no special communications licenses be required. Under such conditions, the Federal Communications Commission (FCC) has prescribed by regulation that the radiated power must not exceed 100 milliwatts if compliance with its many regulations and licensing requirements is to be avoided. Therefore this power limitation is unavoidable as a practical matter.

The effectiveness of utilization of this radiated transmitter power (100 milliwatts maximum) is further limited by antenna inefficiencies. Because of practical limitations on the size of the transmitting antenna which a performer can carry, and the requirement that the antenna be omnidirectional (so that it will radiate to the remote receiver independently of turning movements of the performer as he moves through the audience) the antenna efficiency cannot be maximized, resulting in an effective loss of transmission power. Similarly, it is rarely practicable to provide the receiver unit with a sufficiently large antenna to provide maximized reception efficiency.

Because of these power and efficiency limitation, noise sources present in a theater or night club establishment which might otherwise not be troublesome, become a matter for concern, and their effect on the system must be minimized. Such noise surces may include air conditioning units, motors, fluorescent lighting, blenders utilized by bartenders, kitchen equipment, etc. Cars and trucks passing the outside of the establishment may also radiate troublesome impulse noise.

Another reason why noise considerations are particularly significant in a wireless remote control music system of the type herein described is the inherent sensitivity of such a system to noise, in the sense that a noise effect which might be insignificant in another type of data transmission system, may be very disruptive in such a music system.

For example, where a performer is moving about with a portable transmitter having a plurality of keys while playing a composition thereon, the system herein described provides for transmission of a code identifying the depressed keys, so that the remote receiver unit can cause a musical device depressions as a piano or organ to reproduce the key depressios of the portable transmitter to play the desired musical composition. It is not difficult to see that if a dissonant note appears in the midst of the composition at a key far above or below the key of the composition being played, the effect would be highly disruptive. In such a musical system, even a single wrong note of this type caused by a noise impulse could destroy the effect the performer is seeking to achieve. Obviously, the appearance of any undesired note (caused by a noise impulse) during a pause in the performance would likewise by very disruptive.

Thus it is clear that in a wireless remote control music system of the type herein described, a high level of noise immunity is highly desirable.

Accordingly, an object of the present invention is to provide a practical remote control wireless keyboard musical instrument.

Another object of the invention is to provide such an instrument having a high level of noise immunity.

Still another object of the invention is to provide such an instrument in which the required low frequency response characteristics of the receiver unit are alleviated.

SUMMARY

As herein described, according to one aspect of the invention there is provided a remote control wireless keyboard musical instrument, comprising: a musical device having a plurality of musical sound actuating elements, each element when actuated generating a corresponding musical sound; a portable transmitter having a corresponding plurality of keys, each key having an electrical switch coupled thereto and actuatable thereby; electronic switching means for scanning said keyboard switches at a first relatively high rate of speed to ascertain which of said keyboard switches are actuated; scan inhibiting means for temporarily interrupting the operation of said scanning means when an actuated keyboard switch is detected by said scanning means; transmitting means responsive to said scan inhibiting means for causing the wireless transmission of a serial code identifying the key corresponding to said actuated keyboard switch, said code being transmitted at a second relatively low rate of speed; means associated with said transmitting means for generating an end of transmission signal when the transmission of said code has been completed; means responsive to said end of transmission signal for resetting said scan inhibiting means to enable said scanning means to resume operation; a receiver for the wireless signals generated by said transmitter, said receiver reconstructing the serial code transmitted by said transmitter; decoding means associated with said receiver for providing a plurality of separate output signals corresponding to respective ones of said portable transmitter keyboard keys and musical device sound actuating elements; error detecting means for providing an error signal indicative of the presence of an error in said reconstructed code; signal gating means coupled to said decoding means and responsive to said error signal for inhibiting the generation of any of said output signals by said decoding means in response to a reconstructed code having an error therein; and means for coupling each output signal of said decoding means to a corresponding actuating element of said musical device, so that actuation of a given key of said portable transmitter results in actuation of the corresponding element of said musical device.

According to another aspect of the invention there is provided a remote control wireless keyboard musical instrument including means for providing reduced sensitivity to radiated impulse noise, comprising: a portable transmitter having a plurality of keys; a musical device remote from said transmitter for generating a separate musical sound corresponding to each of said keys; encoding means associated with said transmitter for generating a digital code corresponding to each of said keys, said code being transmitted by said transmitter only when the corresponding key is actuated; said code including (i) a start bit, (ii) a stop bit, (iii) a parity bit, and (iv) a check bit, said start, stop, and check bits having predetermined fixed values, said code further including a number of address bits defining the key corresponding to the code being transmitted, each of said bits occupying a predetermined time interval with respect to said start bit; a receiver responsive to the electromagnetic signals radiated by said transmitter for reconstructing said digital serial code; error detecting means associated with said receiver for detecting an error in said reconstructed code when (i) said check bit is of the wrong value, (ii) said stop bit is of the wrong value, (iii) said parity bit is of the wrong value, and (iv) a given set of address bits of said reconstructed code fails to be repeated within a predetermined time interval; decoding means associated with said receiver for generating a separate output signal corresponding to each of said separate musical sounds; signal gating means coupled to said error detecting means and said decoding means for precluding the generation of said output signal in response to an erroneous reconstructed code; and coupling means for causing said musical device to generate one of said separate musical sounds when the corresponding output signal is generated by said decoding means.

DESCRIPTION OF THE DRAWINGS

The foregoing and other objects, features and advantages of the invention will become apparent from the following detailed description of a preferred embodiment of the invention on conjunction with the accompanying drawings, in which:

FIG. 1 is a block diagram depicting the overall operation of the musical instrument of the invention;

FIG. 2 illustrates the scanning and encoding arrangement employed in the musical instrument of the preferred embodiment of the invention;

FIGS. 4 and 5 are logic diagrams depicting the operation of the keyboard and auxiliary switch scanning matrices of the transmitter unit of FIG. 3;

DETAILED DESCRIPTION

Figure 3:
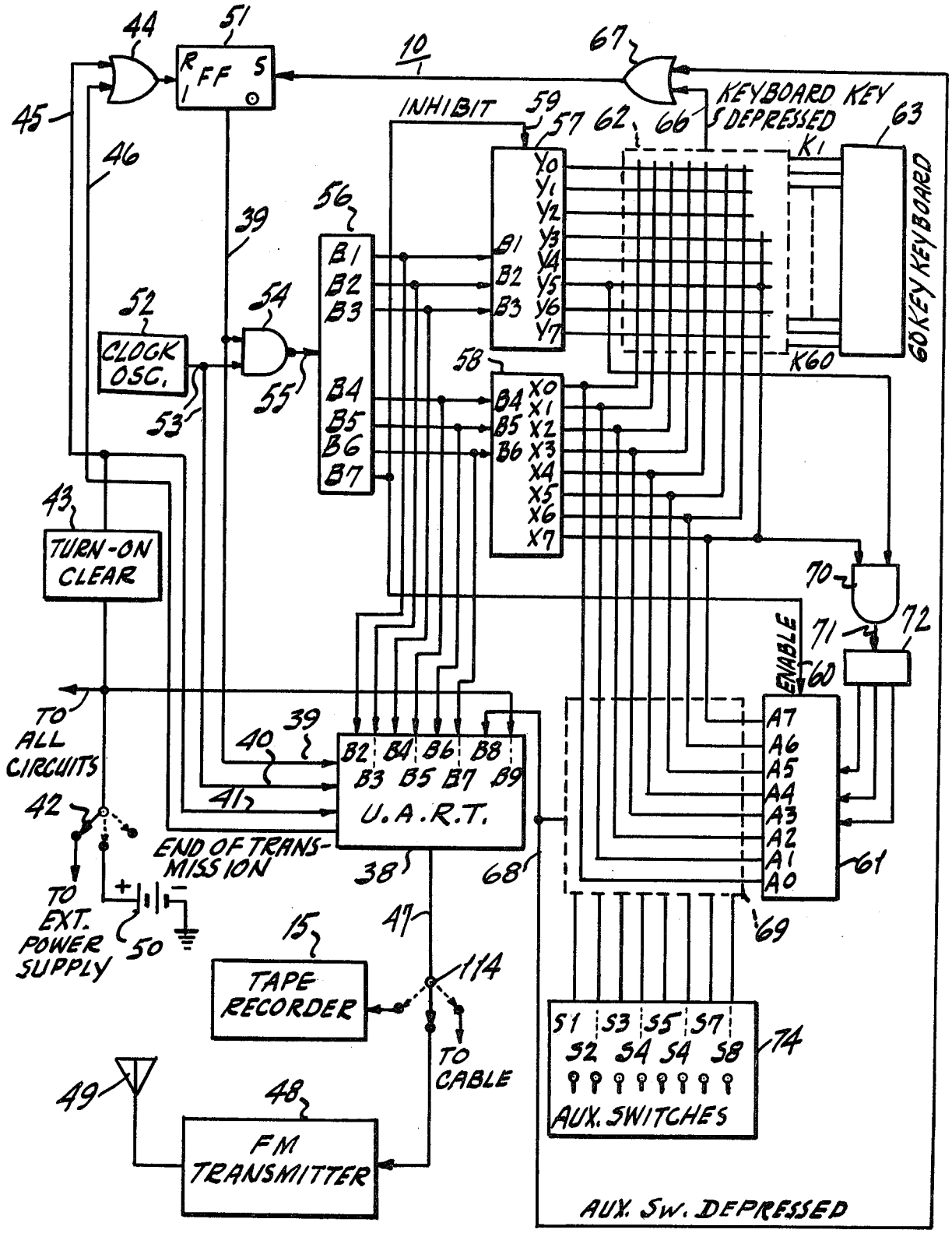
FIG. 3 is a functional block diagram of the transmitter unit of the preferred embodiment of the invention.

The portable transmitter unit 10 of FIG. 1 comprises a housing which is relatively strong and light in weight, and suitably attractive for entertainment purposes. For example, the housing may be made of fiberglass having a high gloss finish, and shaped like a miniature piano. Included in the transmitter unit and secured to the housing are a battery pack, 60 key keyboard, auxiliary function control panel with 8 auxiliary switches, electronic circuitry for scanning the keyboard and auxiliary switchboard and encoding the information as to which keys are depressed and which auxiliary switches are actuated, in the form of a digital code as hereafter described. Also included in the transmitter housing is an FM wireless transmitter unit having a power output capability not exceeding 100 milliwatts, and a modulator for modulating the FM carrier wave with the information contained in the digital code. The transmitter housing should preferably be nonconductive, so that the transmitter antenna can be hidden within the housing and the desired electromagnetic radiation can escape therefrom.

In the embodiment actually constructed, the weight of the transmitter unit 10 was on the order of 15 pounds.

The FM transmitter may utilize any desired carrier frequency, and preferably should employ a frequency at which impulse noise in the area where the system is utilized is reasonably low. In the preferred embodiment, a carrier frequency on the order of 33 MHz. was employed. The FM carrier deviation was on the order of ± 75 KHz. and the audio bandwidth of the FM transmitter (and of the FM receiver incorporated in the receiver unit 11) was on the order of 50 Hz. to 15 KHz.

If desired, a separate battery charger 12 may be employed to recharge the battery pack of the transmitter unit 10 during periods when it is not being used.

Although the key and auxiliary switch data relating to the particular composition being performed is ordinarily transmitted from the transmitter unit 10 to the receiver unit 11 by FM wireless, as indicated by the dashed line 13, a hard wire cable may be utilized for this purpose when practicing or when the transmitter unit is employed on stage or otherwise in close proximity to the receiver unit. This optional cable link is indicated by the numeral 14 in FIG. 1. When the cable link is employed, operating power for the transmitter unit is supplied from the receiver unit over the cable link, to minimize power drain on the transmitter unit battery pack. If desired, circuitry can be incorporated in the system so that, in known manner, the transmitter unit battery pack is recharged over the cable link while the system is in operation.

Another optional feature that may be incorporated in the system shown in FIG. 1 is a tape recorder 15, which have have its input terminals connected to the transmitter unit 10 and its output terminals connected to the receiver unit 11 (at the same time, or at a later time). In this manner the digital signals generated by the transmitter unit (before the FM carrier wave is modulated therewith) may be recorded by the tape recorder as a musical composition is played on the transmitter keys. The bandwidth employed in the preferred embodiment of the invention, i.e. 50 Hz. to 15 KHz., is compatible with that of many tape recorders.

Once the composition has been recorded in digital form by the tape recorder 15, it may be replayed so that the digital information causes the receiver unit 11 to operate in substantially the same manner as if a "live" transmission from the transmitter unit 10 were being received.

The transmitted digital code radiated (on an FM carrier wave) by the transmitter unit 10 includes certain verification data which may be employed by the receiver and decoder unit 11 to detect errors which may be caused by noise or circuit deficiencies.

The receiver unit 11 receives the modulated FM carrier wave generated by the transmitter unit 10, amplifies, limits and demodulates the received signal to reconstruct the digital code corresponding to the depressed keys and auxiliary switches of the transmitter unit, and detects any errors in the received data. The resulting signals are processed to eliminate those containing errors, and are then provided as output control signals on 68 separate lines, one line corresponding to each key of the transmitter unit keyboard and to each auxiliary switch of the transmitter unit switch panel.

The resulting output signals, which are ordinarily in the form of contact closures but which may be in any other desired form, are connected by wires to an electronic organ 16 having 60 corresponding keys and up to 8 corresponding auxiliary functions such as sustain, volume (three levels are provided in the preferred embodiment of the invention), special effects, etc.

The result of the aforementioned arrangement is that a performer may move about through his audience, leaving the receiver unit 11 and the electronic organ 16 (which may be as heavy and large a unit as is desired) on the stage or in any other desired location, and carrying the transmitter unit 10 with him. The performer may then play a desired musical composition by depressing one or more of the 60 keys of the transmitter keyboard (up to 12 keys may be simultaneously depressed) in the desired sequence. As the performer depresses or actuates each key or auxiliary switch of the transmitter unit 10, the corresponding key of the electronic organ 16 is enabled or actuated, causing the corresponding musical sound to be generated by the organ. Thus, with a delay so imperceptible that it cannot be detected by the human ear, the relatively large and heavy organ on the stage plays a musical composition as the performer directs it through his portable transmitter control unit while he moves about the audience, giving a flexible, interesting and entertaining effect.

The connections between the receiver/decoder unit 11 and the electronic organ 16 may involve contact closures actuated by the receiver/decoder unit which are in parallel with the key switches of the keyboard and the organ 16, and in parallel with the coresponding auxiliary function switches of the organ control panel, thus requiring only a minimal modification of the organ circuitry.

Alternatively, where a non-electronic musical device such as a piano is to be remotely played utilizing the system of the invention, or where it is desired to remotely play a device such as an electronic organ without modifying the circuitry thereof in any way, the coupling arrangement indicated within the dashed box 17 of FIG. 1 may be employed.

In the coupling arrangement shown in block 17 of FIG. 1, a mechanical technique is employed to directly actuate the keys of the keyboard musical device (e.g. piano or organ) to be played. This is accomplished by detachably mounting a frame above the device keyboard, the frame having 60 solenoids mounted to it, each solenoid being positioned above a corresponding key and wired to a corresponding output line of the receiver/decoder unit 11. This frame assembly may be of the type shown in U.S. Pat. No. 3,709,085 or in U.S. Pat. No. 1,109,554 (suitably modified in the case of the latter patent). U.S. Pat. No. 883,252 shows an adjustable mounting bracket which may if desired be used to support the frame assembly in aligned relationship with the piano, organ or other musical device keyboard. Similarly, solenoids mounted to a detachable frame may be employed to actuate the pedals of a piano (see FIG. 1 of U.S. Pat. No. 3,709,085) or other auxiliary functions of the musical device being utilized. In the block 17 of FIG. 1, the keyboard material device 18 is shown, in the manner described above, as having its keyboard keys actuated mechanically by the solenoid bank assembly 19, which in turn is electrically activated by the output signals of the receiver/decoder unit 11 on the corresponding lines; and having its auxiliary pedals or other elements actuated mechanically by the auxiliary function solenoid assembly 20, which in turn is electrically activated by the output signals of the receiver decoder on the corresponding lines. Up to 60 keyboard keys and 8 auxiliary functions may be mechanically operated in this fashion.

In a wireless system of the type to which the invention is directed, only a single wireless "channel" is available for transmitting the desired information to control the remote piano, organ, xylophone, or other keyboard material instrument. Therefore all desired information must be transmitted sequentially, and in the preferred embodiment this is done in the form of a serial digital pulse train, one group of 11 bits being transmitted on each scan of the transmitter keyboard and auxiliary panel for each key that is depressed and for no more than one auxiliary switch that is actuated. That is, one complete scan consists of a scan of every one of the 60 keyboard keys of the transmitter unit to determine which keys are depressed or actuated, followed by a scan of a selected one of the 8 auxiliary switches for the same purpose. On the next complete scan, all of 60 keyboard keys are again scanned, and a different one of the auxiliary switches is scanned. Thus the keys of the transmitter keyboard are scanned eight times as frequently as any given switch of the transmitter auxiliary switchboard or panel.

The reason for the scanning of keys at a higher rate than the scanning of auxiliary switches is simply that the time for any one complete scan must be minimized to provide the maximum available number of scans in a given time interval, so that when the performer plays rapidly no "flutter" or "strobing" effects occur. Since a performer normally changes the positions of auxiliary switches at a much slower rate than he plays the keyboard keys, no harm is done by providing a lower effective scanning rate for the auxiliary functions, and the scan repetiton rate is thereby increased.

In the preferred embodiment of the invention, an asynchronous scanning technique, similar in some repsects to that employed in the arrangement of U.S. Pat. No. 3,899,951, is employed to provide an effectively variable scanning rate which matches the performer's characteristics and enables efficient utilization of available bandwidth and scanning rates.

Basically, this scanning technique, which will be best understood by reference to FIG. 2, operates as follows.

Each complete scan period, starting with time 21 and ending with time 22 on the time base indicated generally as 23 in FIG. 2, consists of 128 rapid scan intervals, each comprising one cycle (12.5 microseconds) of the 80 KHz. clock which controls the scanning operation. The first 60 of these intervals (lasting a total of 750 microseconds) are employed to scan the corresponding 60 keys of the transmitter 10 keyboard, in random order or in any desired order; the scanning order is not usually important, so long as the receiver/decoder unit is wired to decode the resulting digital signals in accordance with the actual scanning information.

Thus, if no keys of the transmitter keyboard are depressed, the keyboard is scanned in 750 microseconds.

The next "key" scanned is a so-called "dummy key", the "61st" key. This "key", which corresponds to a non-existent key on the transmitter keyboard, is wired into the logic circuitry of the transmitter unit 10 so that it is sensed as always being depressed. Thus, when the scan reaches this 61st "dummy " key, the transmitter logic is "fooled" into determining that a key is depressed. The logic circuitry than causes the transmitter unit to "pause" or temporarily interrupt the scan, while a code is transmitted identifying this "dummy" key.

At the receiver, the "dummy key" signal is processed but it is not utilized, since the key corresponding to the "dummy" code is non-existent.

The reason that the "dummy key" circuitry is included in the transmitter unit logic is that it effectively increases the low frequency cutoff which can be tolerated in the transmitter and receiver circuits by establishing a minimum frequency for the transmitted signal (i.e. a minimum modulation frequency). If the dummy key were not present, then during periods where the performer pauses, without any transmitter keys being depressed or transmitter auxiliary switches being actuated, the transmitter would radiate only the FM carrier wave, permitting the receiver to receive no audio signal upon demodulation of the (unmodulated) carrier wave and resulting in discharge of the capacitors in the receiver coupling circuits, this discharge, or "drop" would cause a shifting of DC levels in the receiver circuits which may result in decoding errors when the next digital pulse train corresponding to depression of a transmitter key or actuation of an auxiliary switch is received. To tolerate even short pause periods, the receiver circuitry would be required to have an extended low freqency response, which could only be achieved by adding to the cost and complexity of the receiver and/or at the sacrifice of other receiver performance parameters.

This requirement for extended low frequency receiver response which would otherwise exist is alleviated by the "dummy key", which serves the purpose of generating a pulse train on each scan cycle to effectively "chop" the transmitted signal, so that a digital pulse train is transmitted once each scan cycle. This establishes a minimum frequency for the transmitted signal, so that an extended low frequency receiver response characteristic is no longer required.

As will hereinafter be described in detail, the pulse code corresponding to each transmitter key or transmitter auxiliary switch consists of 11 bits, and is transmitted (by modulation of the FM carrier wave) at a 5 KHz. bit rate. That is, each bit has a duration of 200 microseconds, so that 2.2 milliseconds are required for transmission of a code identifying a single key or switch and consisting of 11 bits.

Thus, since a complete rapid scan of the transmitter keyboard keys and of one auxliary switch, as previously mentioned, takes, if no keys or switches are depressed or actuated, 128 scan intervals of 12.5 microseconds each, or 1.6 milliseconds, and since the dummy key code, lasting 2.2 milliseconds, is transmitted on every scan of the keyboard, and since a new scan of the keyboard commences as soon as one complete 128 interval scan has been completed, thus if no keys or switches of the transmitter keyboard or auxiliary panel are depressed or actuated, the dummy key code will be transmitted at repetitive intervals 3.8 milliseconds apart, corresponding to a minimum transmission frequency of approximately 263 Hz.

The low frequency cutoff of the receiver should preferably be somewhat less than 263 Hz. to minimize drop at the 263 Hz. minimum frequency and thus provide highly reliable receiver operation to establish a DC reference level for the received pulse train. A low frequency cutoff on the order of 50 Hz. has been found to be adequate for this purpose.

After the scanning logic of the transmitter unit has paused, and the transmission of the dummy key code is completed, the scanning operation resumes, at the relatively high speed of 12.5 micreseconds per scan interval. The scan continues until the end of the interval is reached, and then repeats. After the dummy key code has been transmitted, the scan logic scans only one of the eight auxiliary switches during a portion of the remaining scan time. If the auxiliary switch scanned is actuated, the scan logic again "pauses" to transmit the code corresponding to the actuated switch, and then resumes.

Thus, if only one keyboard key is depressed, and no auxiliary switches are actuated, the scanning logic completes one scan in (i) 1.6 milliseconds rapid scan time + (ii) 2.2 milliseconds to transmit the code of the depressed key + (iii) 2.2 milliseconds to transmit the dummy key code, or a total of 6.0 milliseconds. Thus under these conditions, which are conditions under which a performer could play the keyboard very rapidly (since he is using only one finger at a time), the frequency with which the scan cycle is repeated, of the refresh rate, is 1/0.006 = 167 scans per second.

If the performer utilizes all the auxiliary switches, and all his fingers, playing 10 keyboard keys simultaneously, the scanning logic completes one scan in (i) 1.6 milliseconds rapid scan time + (ii) 22 milliseconds to transmit the codes of 10 depressed keys + (iii) 2.2 milliseconds to transmit the dummy key code + (iv) 2.2 milliseconds to transmit an auxiliary switch code (since only one auxiliary switch code is transmitted on each scan cycle), or a total of 28 millisecnds. Under these conditions the refresh rate drops to 1/0.028 = approximately 36 scans per second. However, it is apparent that under these conditions the performer will not be able to play as rapidly as under the conditions of the previous paragraph, so that the system provides a refresh rate which matches the performer's capabilities, i.e. a higher refresh rate when the performer can play more rapidly, and a lower refresh rate at times when the performer plays more slowly. This technique allows the logic circuitry to make efficient use of the available counting and data transmitting speeds.

Since a refresh rate for the auxiliary switches of the transmitter unit auxiliary swtich panel one-eighth of the keyboard key refresh rate has been found to be satisfactory, due to the relative slowness with which auxiliary functions are changed by a performer in comparison with keyboard movements, the aforementioned scanning technique allows transmission of auxiliary function data with minimal reduction in the refresh rate for the keyboard keys.

Referring again to FIG. 2, a scanning cycle is depicted adjacent the base line 23, in which one keyboard key and one or more auxiliary switches are actuated. In the example shown in FIG. 2, the 20th keyboard key in the scanning sequence is shown to be actuated (this may or may not be the 20th key in the order in which the keys are mechanically disposed on the keyboard), as well as the 8th auxiliary switch.

Commencing with the time 21, when the transmitter unit is turned on (or when a new scan commences), the keyboard of the transmitter is scanned at 12.5 microseconds per key until the 20th key is reached. In the scheme employed here, each key is identified by a two-digit octal code, the code for the 20th key in the scan sequence being $X_2X_4$ or, in octal notation, 24. Upon encountering the actuated 20th key, the scan logic pauses, and transmits, at a 5 KHz, bit rate, the digital pulse train code 24 shown in FIG. 2.

This digital pulse train code consists of 11 bits, i.e. B1 through B11, each of which has a particular significance, as follows:

| | |
|---|---|
| B1 | This bit is always negative (low) and acts as the Start bit of the pulse train code |
| B2 | The least significant bit of the binary number comprising the least significant (Y) digit |

-continued

| | |
|---|---|
| | of the octal number identifying the key on the transmitter keyboard which is depressed |
| B3 | The next most significant bit of the binary number comprising said Y digit |
| B4 | The most significant bit of the binary number comprising said Y digit |
| B5 | The least significant bit of the binary number comprising the most significant (X) digit of the octal number identifying the key on the transmitter keyboard which is depressed; or of the binary number (X) identifying the actuated auxiliary switch being scanned |
| B6 | The next most significant bit of the binary number comprising said X digit or number |
| B7 | The most significant bit of the binary number comprising said X digit of number<br>Note: For a code identifying a keyboard key, the entire X,Y octal number is used. For a code identifying an auxiliary switch, only the X digit/number is used. |
| B8 | Auxiliary function signal; positive (high) when the code represents an auxiliary switch which is actuated - negative (low) when the code represents a keyboard key which is depressed |
| B9 | Check bit - always positive (high) |
| B10 | Parity bit - has a value such that the total number of positive (high) bits, including the parity bit but excluding the Stop bit, is an odd number |
| B11 | This bit is always positive (high) and acts as the Stop bit of the pulse train code |

In the code 24 of FIG. 2, it is seen that the bits B2, B3 and B4 are 0, 0 and 1 (low, low, high), corresponding to a Y digit value 100, or 4 in octal notation. Similarly, the bits B5, B6 and B7 are 0, 1 and 0, corresponding to an X digit value 010, or 2 in octal notation. Thus the X,Y octal address is 24.

B8 is 0, indicating that the address code refers to a keyboard key rather than to an auxiliary switch.

B9 is high, because it is always high, for purposes of providing improved noise immunity, as hereafter described.

B10, the parity bit, is 0 because the total number of the other bits which are high (B4, B6 and B9) is odd. This parity bit provides an additional capability of detecting errors, as is well known in the digital circuit art.

At the aforementioned 5 KHz, transmission rate, it takes 200 microseconds to transmit each bit, so that 2.2 milliseconds is required to transmit the entire digital pulse train 24.

After the pulse train 24 identifying the 20th key of the transmitter keyboard is transmitted, the scan continues, until the dummy key ($X_7Y_5$) is detected, at which time the scan again pauses for 2.2 milliseconds to permit transmission of the digital pulse train 25 identifying the dummy key, whose address can be seen from the pulse code to be 75 in octal notation. As previously mentioned, the transitions of this dummy pulse code serve to "chop" the transmitted signal to establish a minimum transmission frequency on the order of 263 Hz.

After the dummy key code 25 is transmitted, the scan continues, unrtil the auxiliary switch S8 being scanned on this particular scan cycle, is detected as being actuated. Since there are only 8 auxiliary switches, only the X digit need be used to identify the particular switch which is actuated (the X digit has octal values ranging from 0 to 7 corresponding to auxiliary switches S1 to S8 respectively). The value of the Y digit is of no significance. Upon detecting the actuation of the auxiliary switch S8, the scan again pauses to permit transmission of the corresponding auxiliary switch code 26, which as seen in FIG. 2 includes an octal address 7 (in octal notation) for the switch S8.

It should also be noted that in the digital code pulse train 26, the auxiliary function bit B8 is high, indicating that the code represnts the identity of an auxiliary switch rather than a keyboard key.

After the auxiliary switch code for S8 has been transmitted, the scan continues until the end of the cycle is reached at time 22, at which time the next cycle commences without any significant lost time. The scan sequence referred to above is repeated on the next cycle, except that another auxiliary switch than S8 is scanned. A different auxiliary switch is scanned on each scan cycle, so that each auxiliary switch is scanned once every 8 scan cycles.

The manner in which the check bit B9 and the parity bit B10 cooperate with each other and with the start and stop bits B1 and B11 to provide greatly enhanced suppression of impulse noise is best understood by reference to the waveforms 27, 28 and 29 of FIG. 2, which are drawn in time alignment with the code pulse trains 24, 25 and 26.

By the term "impulse noise" is meant noise which is of a transient nature, and which is normally characterized by a sudden change in amplitude followed by a damped oscillation. Such noise is generated by currents which are suddenly applied or suddenly interruped, and is commonly associated with motor vehicle ignition systems, motors, air conditioning equipment, lighting equipment, etc. This sort of noise usually has an underlying oscillation frequency corresponding to that of the circuit in which the current giving rise to the impulse noise radiation is flowing. Such impulse noise is, as a practical matter, the most prevalent type of noise with which circuits of the type herein described need be concerned. other noise, such as random or "white" noise, is normally sufficiently low in amplitude in systems of the type herein contemplated, so that the problems it presents are small compared to the effects of impulse noise.

Since the system herein described employs a digital code with a parity bit, and the receiver unit 11 (FIG. 1) includes parity check circuitry well known in the art, any digital pulse train (or any signal which may resemble such a pulse train) will result in the playing of a musical note or sound by the organ 16 only if the pulse train meets the requisite odd parity criterion.

For example, a noise signal which looks like a broad negative pulse, having its leading edge corresponding to the start bit B1 and its trailing edge spaced apart so that it occurs in coincidence with the transition to the stop bit B11 (such a pulse would have to be about 2 milliseconds wide), although having the right time elapsed between the "start" and "stop" bits, would not "fool" the system into generating a false note, because the parity requirement would not be met. The receiver/decoder circuitry would interpret such a negative noise pulse (that is, a pulse which has such an appearance after demodulation, or which is of such high amplitude that it forces its way right through the front end of the receiver) as having 0 values for bits B2 thru B10, requiring a high parity value for validation. Thus such a pulse would be rejected as erroneous.

However, if such a negative pulse were to have a width of 1.8 milliseconds, the receiver/decoder would interpret this pulse as having a 0 value for bits B2 thru B9, and a high value for Bits B10 and B11. Thus the parity criterion would be met (in the absence of the check bit B9), and the receiver/decoder would cause a false output signal to be generated to actuate the organ key corresponding to the octal address 00, which represents the least complicated of the possible digital codes of the system herein described.

The presence of the check bit B9, and particularly the presence of the check bit B9 at a point in the digital code pulse train adjacent the parity bit B10, greatly increases the noise immunity of the system, and the substantial improvement in impulse noise immunity thereby achieved has been experimentally verified.

As seen in FIG. 2, the waveform 27 shows the simplest (i.e. least complicated) code which will be accepted by the system as valid when the check bit B9 is employed. This waveform goes negative (low) to start the pulse train, goes positive (high) 1.6 milliseconds later to establish the required positive (high) value of the check bit B9, and goes low 200 microseconds later to establish the required low value of the parity bit B10 (since there is already an odd number — one — of high bits, namely B9 which is always high). This waveform 27 goes high 200 microseconds later to establish the required positive (high) value for the stop bit B11. The waveform described in the preceding sentences corresponds to the code for the organ key having the octal address 00, and is the least complicated code which the receiver/decoder will accept as valid when the system includes the check bit B9.

Thus it is seen that whereas a negative noise pulse having the proper width can fool the system in the absence of the check bit B9, when the check bit is present, and particularly when it is adjacent the parity bit B10, any noise pulse must have a considerably more complicated waveform to fool the system. The waveform shown in FIG. 2 as 27, and the "rounded" simulated noise waveform 28 corresponding thereto, has a shape which indicates an irregular behavior, and which shape is unusual for impulse noise. Thus the combination of the check bit and parity bit as aforesaid greatly increases the impulse noise rejection capability of the system.

Waveform 29 in FIG. 2 illustrates another waveform of relatively low complication which would fool the system. The receiver/decoder would interpret this waveform 29 as corresponding to a 0 value for B2, a 1 value for B3, 0 values for B4 thru B8, 1 value for B9 and B10. Thus the parity criterion would be met, since bits B2, B9 and B10 would be high (an odd number of bits), and the check bit B9 would also meet the criterion that it always be high. The receiver/decoder would respond to this noise pulse by actuating the output line corresponding to the organ key having the octal address 02. However, as before, this is an unusual waveform for impulse noise to have, and the susceptibility to such noise is therefore very low.

If any noise does get through the receiver/decoder validation and error detection circuitry, it is desirable that the false note or notes thereby produced cause as litle disruption as possible. Therefore the transmitter keyboard and the receiver decoder circuitry should preferably be wired so that the least complicated code 27, 28 of FIG. 2 results in actuation of a sound which is common, such as the note of middle C (256 Hz). The next least most complicated codes (i.e. those having the least number of positive to negative transitions) should preferably be either notes in the same range as middle C, i.e. within one octave thereof, or notes which are harmonics or subharmonics of middle C, depending on the judgment of the performer as to which of said notes would be least disruptive in the types of performances which be renders. Alternatively, means could be provided to establish the least complicated codes to correspond to notes within the key in which the particular composition being performed at the time is rendered. This would, of course, require additional switching circuitry to make the necessary changes in key addresses from one composition to the next.

Figure 6:
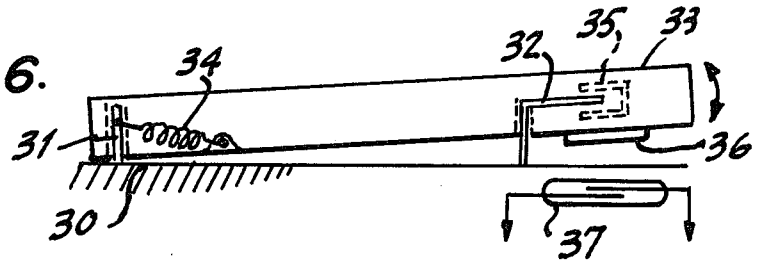
FIG. 6 functionally illustrates the operation of one key of the keyboard of the transmitter unit of FIG. 3.

The manner in which the transmitter unit keyboard keys function is illustrated in FIG. 6, which is not drawn to scale and is intended only to illustrate the mechanism involved.

Extending from a keyboard frame 30 common to all of the 60 keys involved are, for each key, a post 31 and a stop member 32. A hollow key 33 is positioned over the post 31 and member 32, with the post 31 loosely fitting into a sleeve in the key 33, so that the key can pivot slightly on the post. A spring 34 urges the key 33 to tilt upward slightly, i.e. away from the frame 30. A U-shaped member 35 within the key 33 has surfaces disposed above and below the end of the stop member 32 to restrain the range of movement of the key 33. A magnet 36 is bonded to the bottom of the key 33 adjacent the end thereof remote from the post 31. A reed relay 37 is disposed in an aperture in the frame 30, so that when the key 33 is depressed or actuated, the magnet 36 moves closer to the reed assembly 37 to cause the read contacts to close, thereby completing an electrical connection to actuate the desired electronic circuit elements. After the key 33 is released, the spring 34 causes it to pivot away from the read assembly 37, thereby releasing the contacts thereof.

The operation of the transmitter circuitry will be best undestood by reference to FIG. 3, which shows a functional block diagram of the same. The format and characteristics of the digital pulse code train produced by the transmitter have already been described with reference to FIG. 2.

The circuitry shown in FIG. 3 includes standard digital and analog circuit elements and devices, with the possible exception of the U.A.R.T. 38, which is a multifunctional integrated circuit element.

The abbreviation U.A.R.T. stands for Universal Asynchronous Receiver Transmitter. The U.A.R.T. 38 is a device which is commercially available, and if desired its functions can readily be provided by combinations of more conventional digital circuit elements well known in the digital circuit design art. Suitable U.A.R.T. devices are available from (i) American Microsystems, Inc., Santa Clara, California as part No. S1883; (ii) General Instruments, Inc. Hicksville, L.I., New York as part No. Ay-5-1013; and (iii) Texas Instruments, Inc., Dallas, Texas as part No. TMS 6011. The literature published by these companies on the above devices is readily available, and is incorporated herein by reference.

The U.A.R.T. 38 has input terminals for receiving digital signal levels in parallel form for the bits corresponding to B2 thru B9 of the digital code illustrated in FIG. 2. When initiated by a high level on input line 39, the U.A.R.T. will format the input information (bits B2 thru B9) by adding a start bit B1, a stop bit B11 and a parity bit B10 (odd parity as previously described), and will clock out said bits (i.e. B1 through B11, in that order) as a serial digital pulse code train at a rate equal to 1/16 of the frequency of clock pulses supplied to it on line 40. The U.A.R.T. registers can be initially cleared by a clear or reset pulse supplied on line 41. When the transmitter unit 10 is turned on by on-off switch 42, this clear pulse is provided to the U.A.R.T. by the turn-on clear circuit 43, which also provides a clear pulse at that time to the OR gate 44 on line 45.

When the U.A.R.T. has completed clocking the serial pulse train containing bits B1 to B11, it generates an End of Transmission signal on line 46, which is connected to an input of the OR gate 44. The output pulse train from the U.A.R.T. 38 appears on line 47, and may be coupled to (i) the tape recorder 15, (ii) the modulator circuit of the FM transmitting module 48, or (iii) a cable connected directly to the receiver 11 (FIG. 1). If desired circuit connections can be provided to permit recording by the tape recorder 15 at the same time that the FM transmitter module 48 is transmitting performance data to the remote receiver/decoder unit 11.

The output of the FM transmitter 48 is coupled to the transmitting antenna 49, which is preferably small and concealed within the non-conductive transmitter unit housing. Suitable operating voltages for the transmitter unit 10 are provided by a DC power supply 50, which may typically comprise a battery pack and a switching regulator/converter.

When the power switch 42 is turned on (either by connection to the battery pack/supply 50 or to an external power source, the clear pulse provided by the turn-on clear circuit 43 clears the U.A.R.T. registers and, via the OR gate 44, resets the set-reset flip-flop 51 so that a low level appears on its output line 39.

Clock pulses at an 80 KHz. rate are continually produced by the clock oscillator 52 on line 53, and as inputs to the NAND gate 54 and on the clock line 40 of the U.A.R.T. 38.

The output of the NAND gate 54 is connected to the input terminal 55 of the seven bit digital counter 56. Since initially the output of the flip-flop 51 on line 39, which is connected to an input terminal of the NAND gate 54, is low, the pulses generated by the clock oscillator 52 appear at the output terminal 55 of the NAND gate 54, and are counted by the counter 56.

The three least significant bits B1, B2 and B3 of the output of the counter 56 (which bits correspond to bits B2, B3 and B4 of the U.A.R.T. 38) are decoded by a decimal decoder 57, so that output signals appear in sequence on output lines $Y_0$ thru $Y_7$ of the decoder 57, only one line being active at a time, and each line being active for 12.5 microseconds. The lines become active in sequence, with the sequence being repeated when $Y_7$ turns inactive.

The next three more significant bits B4, B5 and B6 (corresponding to bits B5, B6 and B7 of the U.A.R.T. 38) are decoded by decimal decoder 58, so that output signals appear in sequence on output lines $X_0$ thru $X_8$ of the decoder 58, only one line being active at a time, and each line being active for 100 microseconds. The lines become active in sequence, with the sequence being repeated when $X_7$ turns inactive.

The most significant bit produced by the counter 56, B7, is coupled to an inhibit terminal 59 of the decoder 57, and to an enable terminal 60 of a decimal decoder 61.

The counter 56, having seven bits, counts up to 128. That is, the counter 56 counts a total of 128 pulses produced by the clock oscillator 52, which produces 80,000 pulses per second. Thus each count of the counter 56 takes 1/80,000 sec., or 12.5 microseconds. The total counting time of the counter 56 for one complete counting cycle (not including periods when the counting operation is temperarily interrupted, or "pauses") is thus 128 × 12.5 microseconds = 1,600 microseconds or 1.6 milliseconds. The line connected to the most significant bit, B7, is high for the final 800 microseconds of each counting cycle, and thus during this interval the decoder 57 is inactive and the decoder 61 is enabled.

The eight output lines of the Y decoder 57 and the eight output lines of the X decoder 58 are connected to sixty AND gates in a keyboard matrix circuit 62. That is, the AND gates are arranged in columns and rows, with the Y outputs being connected to the respective rows and the X outputs being connected to the respective columns. The $Y_0$ output is connected to input terminals of the AND gates in the first row, the $Y_1$ output is connected to input terminals of the AND gates in the second row, etc. The $X_0$ output is connected to input terminals of AND gates in the first column, the $X_1$ output is connected to input terminals of AND gates in the second column, etc. Only 60 of the possible 64 addresses of the matrix 62 are so utilized.

60 signals from corresponding ones of the reed relays 37 (FIG. 6) of the 60 key transmitter keyboard 63 are coupled to the various AND gates of the matrix 62, one signal being connected to each AND gate corresponding to a particular keyboard key being depressed or actuated. Thus the matrix 62 comprises 60 AND gates, each having three input terminals, a first terminal connected to a corresponding Y output, a second terminal connected to a corresponding X output, and a third terminal connected to a corresponding keyboard key depression signal output.

In addition to the 60 three-input AND gates in the matrix 62, the matrix also contains one two-input "dummy key" AND gate, the inputs to which are the $Y_5$ output line and the $X_7$ output line. An output pulse appears at the output terminal of this AND gate at the 61st scan position, i.e. 750 microseconds after the scanning operation commences with the appearance of input pulses at terminal 55 of the counter 56 (i.e., in the case where the scan has not been interrupted as a result of any of the key of the keyboard 63 being depressed).

The AND gate structure of the matrix 62 is illustrated functionally in FIG. 4, wherein there are 60 AND gates 64 as described above, and one additional two-input "dummy key" AND gate 65. The output terminals of all 61 AND gates are logically connected together in an overall OR arrangement, so that an output signal appears on the Key Board Key Depressed line 66 whenever an output signal appears at an output terminal of any of the 61 AND gates.

As the output signals of the decoders 57 and 58 appear in sequence, each X output line being active for 100 microseconds while the corresponding Y rows are rendered active for 12.5 microseconds each, so that the columns are sequentially scanned until all of the AND gates of the matrix have been scanned, an output signal appears on the Keyboard Key Depressed line 66 when the scan encounters a depressed keyboard key. This signal on line 66, via the OR gate 67, sets the flip-flop 51 to cause its output line 39 to go high.

When line 39 goes high, the output pulses of the NAND gate 54 on line 55 cease to appear, and the U.A.R.T. 38 is simultaneously given a signal on line 39 causing it to initiate transmission. The U.A.R.T. then begins to clock out a serial digital pulse train on line 47, corresponding to the digital information which is present at its input terminals B2 thru B9.

The B1 thru B6 output lines of the counter 56 are connected to the B2 thru B7 input lines of the U.A.R.T. respectively, so that these bits comprise a digital code corresponding to the address within the matrix 62 of the particular depressed keyboard key which has been sensed during the scan of the matrix. The B9 input of the U.A.R.T. is connected to the "hot" side of on-off switch 42, so that B9 is always high. The B8 input of the U.A.R.T. is connected to the Auxiliary Switch Depressed output line of the auxiliary switch matrix 69. Since the auxiliary matrix is inactive at this time (because no enable signal is present on line 60 to the decoder 61), the signal on line 68 is low.

The U.A.R.T., having received the initiate transmission signal on line 39, now formats the input data B2 thru B9 with a parity bit B10 and start and stop bits B1 and B11, and transmits to the FM transmitter module 48 on line 47 a corresponding serial digital pulse train (of the type illustrated in FIG. 2) containing the address of the depressed keyboard key.

After the U.A.R.T., 2.2 milliseconds later, has completed clocking out the serial digital pulse train at a 5 KHz. bit rate, it generates an End of Transmission signal on line 46, which, via the OR gate 44, resets the flip-flop 51 so that its output on line 39 goes low. This low output on line 39 disables the U.A.R.T. by removing its initiate transmission signal, and simultaneously causes clock pulses to once again appear at the output line 55 of the NAND gate 54, so that scanning of the matrix 62 is resumed.

The foregoing process is repeated each time a depressed keyboard key is sensed by the matrix 62. After all 60 keyboard keys have been scanned, the "dummy key" whose octal address is 75 is scanned and its corresponding code 25 (see FIG. 2) is transmitted.

Three clock intervals (37.5 microseconds) after the transmission of the dummy key code has been completed, the B7 output line of the counter 56 goes high (and remains high until the end of the scan cycle), inhibiting the outputs of the decoder 57 and enabling the outputs of the decoder 61.

At the same time that the "dummy key" is detected by the matrix 62, a corresponding "dummy key" counting pulse appears at the output of AND gate 70, on line 71. This counting pulse appears as a result of coincidence of the two inputs $X_7$ and $Y_5$ to the AND gate 70, said inputs corresponding to the "dummy key" address.

The dummy key pulse output on line 71 is coupled as an input signal to the 8 bit counter 72, the output of which (on three lines) is coupled as the input to the decoder 61. Thus the output of the decoder, when enabled, renders lines $A_0$ thru $A_8$ active for successive periods corresponding to one scan cycle (i.e. the total time between occurrence of one dummy key signal and occurrence of the next dummy key signal on a succeeding cycle).

Each of the 8 outputs of the decoder 61 is coupled to a corresponding one of the 8 X outputs of the decoder 58 within the auxiliary switch scanning matrix 69, by each of said lines being connected as an input to a corresponding three-input AND gate 73, as functionally illustrated in FIG. 5. A corresponding signal indicating actuation of one of the auxiliary switches S1 thru S8 of the auxiliary switch panel or switchboard 74 is connected as an input to each of the AND gates 73.

Therefore each auxiliary switch is scanned during the second half of one out of every eight scan cycles. That is, since only one of the lines $A_0$ thru $A_7$ is active during the second half of a particular scan cycle, only the corresponding auxiliary switch is scanned on that particular scan cycle.

When, during the second half of a scan cycle, an auxiliary switch is detected as being actuated, the Auxiliary Key Depressed line 68 of the auxiliary matrix 69 goes high (since the outputs of all eight AND gates of the auxiliary matrix 69 are connected together in a logical OR arrangement), providing a high or "1" input for the B8 bit of the U.A.R.T. 38, and, via OR gate 67, causing the U.A.R.T. 38 to transmit a digital code identifying (by its X address) the particular auxiliary switch which is depressed and being scanned at that time. The operation of the U.A.R.T., the flip-flop 51, NAND gate 54 and counter 56 is essentially the same when an auxiliary switch actuation is detected by the matrix 69, as it is when a keyboard key actuation is detected by the matrix 62.

After the pulse train identifying the auxiliary switch has been transmitted, the scan resumes, i.e. pulses from the clock 52 are counted by the counter 56 and decoded by the decoder 58, at the relatively high scanning rate (compared with the rate at which a pulse train is clocked out by the U.A.R.T. 38) until the counter 56 reaches its maximum capacity and automatically resumes counting again from zero, thus commencing the next scan cycle.

In summary, the transmitter unit 10 logical sequence of operations may be expressed in the form of a "program", as follows:

(1) Generate turn-on signal
(2) Reset registers and start scanning keyboard
(3) Continue scanning keyboard at 12.5 microseconds per key
(4) Sense a depressed keyboard key
(5) Stop scanning keyboard
(6) Initiate transmission of code for depressed key from U.A.R.T. Transmission takes 2.2 milliseconds per key at 5 KHz. bit rate (11 bits per key code)
(7) U.A.R.T. generates End of Transmission signal
(8) Repeat steps 3 to 7 until 60 keys have been scanned
(9) Sense dummy (61st) key
(10) Repeat steps 5 to 7 for dummy key code
(11) Scan auxiliary switchboard to sense whether first auxiliary switch is depressed (if not interrupted, this scan takes 850 microseconds)
(12) If first auxiliary switch is depressed, stop scanning auxiliary switchboard
(13) Initiate transmission of code for first auxiliary switch from U.A.R.T. Transmission takes 2.2 milliseconds
(14) U.A.R.T. generates End of Transmission signal
(15) Repeat steps 3 to 10
(16) Repeat steps 11 to 15 for second auxiliary switch, then for third auxiliary switch, etc., so that all auxiliswitches are sensed in a period of each eight keyboard scans The manner in which the receiver/decoder unit 11 processes the wireless signals recieved from the transmitter unit 10 to eliminate erroneous data and to operate the keys and auxiliary switches of an organ, piano, xylophone or other keyboard musical device, is best understood by reference to FIG. 2, which shows the operation of said receiver/decoder in functional block form.

The wireless electromagnetic signal radiated by the antenna 49 of the transmitter unit 10 is picked up by the receiving antenna 75 and coupled to the input terminal of the FM receiver module 76 on line 77. In conventional fashion, the receiver module 76 amplifies, limits and demodulates the signal to reconstruct a waveform corresponding to the digital pulse train originally generated by the U.A.R.T. 38 of the transmitter 10. The bandwidth of the receiver module 76 (audio bandwidth) is 50 Hz. to 15 KHz. The resulting signal, which resembles an imperfect pulse train with rounded corners due to the characteristics of the transmitter module 48 and the receiver module 76, is coupled to a signal conditioner module 78 through switch 79 on line 80. Switch 79 also has a position which enables the output of the tape recorder, if desired, to be supplied to the signal conditioner 78 instead of the output of the FM receiver module 76.

The signal conditioner 78 converts the "crude" waveform from the receiver module 76 to a "clean" pulse train, and comprises a Schmitt trigger 81 for generating transitions at the zero crossovers (approximately) of the waveform being processed (the low positions of the waveform are clamped to a reference level prior to the Schmitt trigger), and an amplifier/switch 82 for insuring that the resulting pulse train has a fixed amplitude and fixed upper and lower DC levels.

The resulting "clean" pulse train is routed to the input terminal 83 of the U.A.R.T. 84 via switch 84, which may if desired be positioned to alternatively supply the input to the U.A.R.T. from a cable connected to the transmitter unit 10.

The receiving U.A.R.T. 84 may comprise the same physical device as the transmitting U.A.R.T. 38, but is externally wired in known fashion to function in the reverse manner. That is, the U.A.R.T. 84 receives, in addition to the input serial digital pulse train, (i) clock pulses from the 80 KHz. clock oscillator 85 on line 86, (ii) an initial signal to reset its registers from the turn-on clear circuit 87 on line 88, and (iii) an Acknowledge Presence of Word signal on line 89.

When a pulse train enters the U.A.R.T. 84 on line 83, the U.A.R.T. checks to insure that (i) the stop bit, i.e. the bit which appears 2 milliseconds after the forst received or start bit, is high, and that the parity bit B10 is of the correct value. If either of these conditions is not met, the U.A.R.T. generates an Error signal on line 90.

When the U.A.R.T. has received a complete 11 bit word and stored it in its output register, the U.A.R.T. generates a Word Received signal on line 91, indicating that a complete digital code word corresponding to a depressed transmitter keyboard key or actuated transmitter auxiliary switch is available for utilization.

At the time the Word Received signal is generated by the U.A.R.T. 84, the output bits are available in parallel form, i.e. bits B2 thru B9.

Bits B2 thru B8 are connected to corresponding inputs of the address decoder 92, which provides 68 separate outputs, one corresponding to each keyboard key and each auxiliary switch of the transmitter unit 10. As previously discussed, bits B2 through B7 identify the particular key depressed, if B8 is low; and bits B5 thru B7 identify the particular auxiliary switch actuated, if B8 is high.

The Word Received signal is coupled through a 0.5 millisecond delay circuit 93, to allow for settling of the address decoder 92, followed by a 0.5 millisecond timer (monostable multivibrator) circuit 94, which provides a 0.5 millisecond wide "Data Available" signal/gate on line 95. The output of the timer is connected to the Acknowledge Presence of Word input line 89 of the U.A.R.T. 84, to enable the U.A.R.T. to begin clocking into its registers another 11 bit code word (pulse train) from the signal conditioner 78 on line 83. The 0.5 millisecond wide "Data Available" signal from the timer 94 is coupled to each of 68 data validation/output channels 96 through an error gate 97.

The error gate 97 may be shut off or inhibited by an Error Present signal on line 98. The Error Present signal, i.e. the output of OR gate 99, is generated whenever (i) an error is detected by the U.A.R.T. validation circuitry as previously mentioned, or (ii) bit B9, the check bit, is not high. Either of these conditions, a high level on line 90 indicating the U.A.R.T. has detected an error. or a low level on B9 indicating a check bit of the wrong value (converted to a high value by the inverter 100), causes a shutoff or inhibit signal to appear on line 98, so that the Data Available signal on line 95 is not permitted to reach the corresponding one of the validation/output channels 96. Thus those digital pulse trains which are determined to be erroneous do not result in any output from the receiver unit 11.

The error-gated Data Available signal, on line 101, is applied as a gating or enabling signal to the control terminal of the valid data gate 102 of each of the channels 96. Thus, when the U.A.R.T. 84 has received and processed a digital pulse train corresponding to an 11 bit word identifying a particular depressed key or actuated auxiliary switch, the corresponding output channel 96 receives a signal from the decoder 92, which is gated into the output channel 0.5 milliseconds later if no error in the word is detected by the U.A.R.T. 84 and if the check bit B9 is high. The Data Available gate is, as previously discussed, 0.5 milliseconds wide, so that a 0.5 millisecond pulse appears on output line 103 of the valid data gate 102 of the particular key or switch identified in the decoded word.

This 0.5 millisecond pulse on line 103 is applied (i) to the trigger input terminal of a first retriggerable monostable multivibrator 104 and (ii) to the trigger input terminal 105 of a second retriggerable monostable multivibrator 106. The output of the first monostable multivibrator 104 (which output pulse is 33 milliseconds wide for each of the 60 keyboard key channels, and 300 milliseconds wide for each of the 8 auxiliary switch channels) is applied, through a 0.7 millisecond delay circuit 107, to the enable terminal 108 of the second multivibrator 106.

The multivibrators 104 and 106 and delay circuit 107 cooperate to provide a dual timer data validation circuit which permits an output signal to be generated by the corresponding channel only if within a predetermined time after a corresponding digital word is received by that channel (said time being 33 milliseconds for key channels and 300 milliseconds for auxiliary switch channels, which are scanned only one-eighth as frequently), another word is received by the same channel. Thus two successive words must be received by a given channel befor it will produce a corresponding output signal, providing additional protection against errors due to noise, such error being very unlikely to repeat the code for a given channel on two successive scans.

The dual timer data validation circuitry operates as follows.

The 0.5 millisecond wide data pulse received on line 103 triggers multivibrator 104, whose 33 (or 300) millisecond wide output pulse begins to arrive at the enable terminal 108 of multivibrator 106 about 0.7 milliseconds later. The trigger input terminal 105 of the multivibrator 106 receives the 0.5 millisecond wide data pulse immediately, however, and the data pulse immediately, however, and the data pulse expires before the enable pulse begins to arrive at terminal 108. Therefore the multivibrator 106 does not fire, and the enable pulse remains present for another 33 (or 300) milliseconds. Since even with 10 keys depressed as well as all auxiliary switches actuated, the time required for one complete scan is 28 milliseconds, if the systems is operating properly, i.e. without errors due to noise, another data pulse will appear on line 103 and at terminal 105 before the 33 millisecond wide enable pulse expires. This second data pulse (assuming the key remains depressed for one complete scan period, which is normally the case) triggers the second multivibrator 106, which then provides a 33 (or 300 for auxiliary switch channels) millisecond wide pulse to the transistor output switch 109 on line 110. As long as the data is refreshed, i.e. a fresh data pulse appears on line 103, within the requisite 33 (or 300) millisecond period, the multivibrators 104 and 106 continue to retrigger, providing constant level output signals and keeping the transistor switch 109 ON so that an output is produced at the corresponding output terminal 11 to actuate the corresponding key or auxiliary function of the piano, organ, xylophone, or other keyboard musical device to be remotely played.

Power for the receiver unit 11, and if desired for operation and/or recharging the transmitter unit 10, is provided by a power supply 112 via an on-off switch 113.

Since it takes 2.2 milliseconds for each word to enter the U.A.R.T., and since the U.A.R.T. 84 begins to receive a new word after it has completed the reception of the previous word and generated a Word Received signal on line 91, it follows that the earliest a subsequent word can be read out from the U.A.R.T. is 1.2 milliseconds after the Data Available signal ends on line 101 (since this signal ends 1 millisecond after the Word Received signal appears.

The foregoing detailed description is by way of example only, and it will be apparent to those skilled in the art that the word size, data processing and transmission rates, and circuit details, as well as number of keys and functions provided, may be varied without departing from the spirit of the invention.

Among the more important modifications or applications of the invention is the use of the tape recorder 15 in conjunction therewith to perform dubbing or mixing and related program modification functions.

Figure 7:
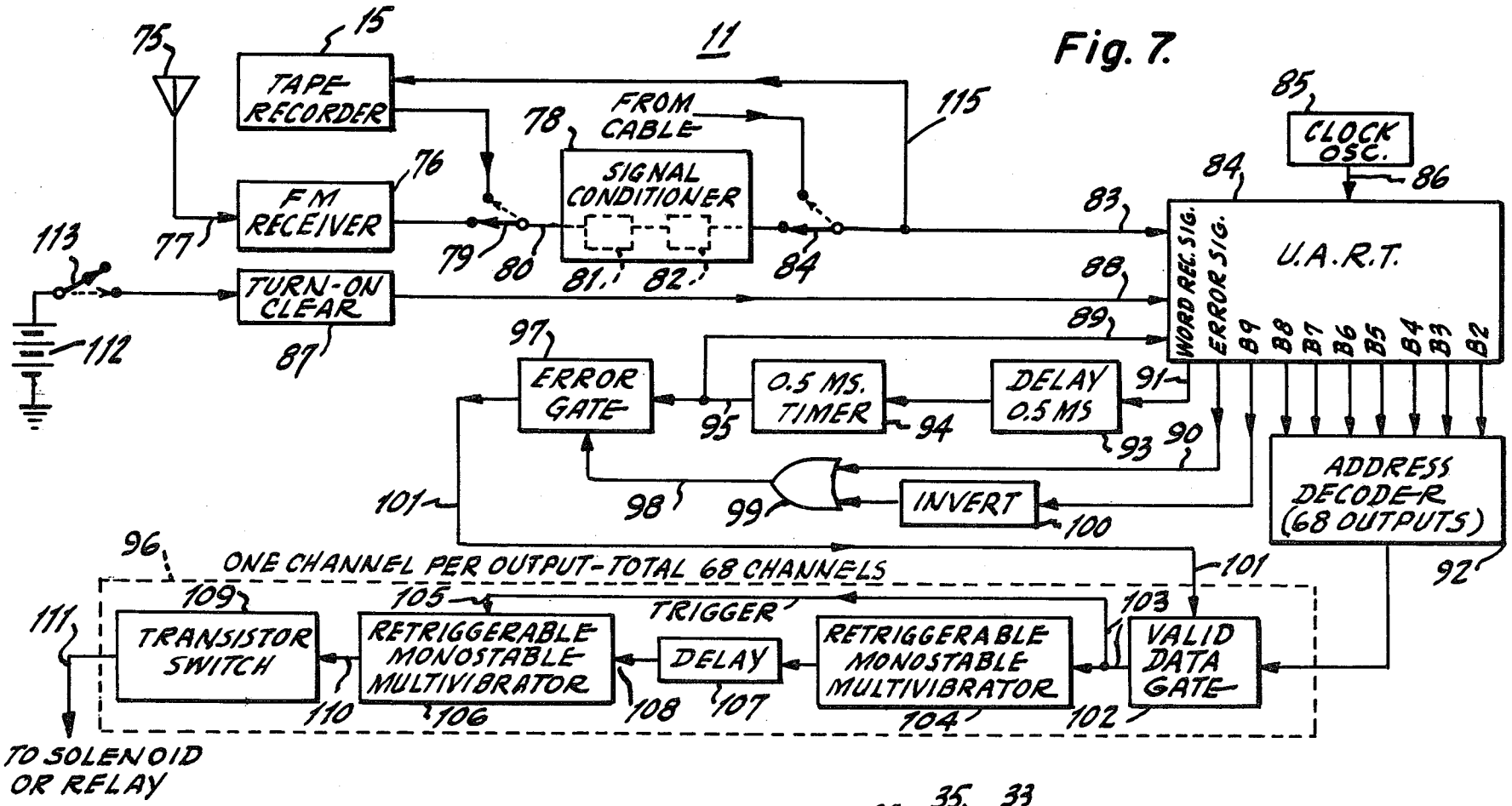
FIG. 7 is a functional block diagram of the receiver unit of the preferred embodiment of the invention.

For example, the switch 114 (FIG. 3) may be such that the output of the U.A.R.T. 38 can be simultaneously connected to the FM transmitter 48 and the tape recorder 15, so that the musical composition being performed can be recorded at the same time that it is being performed before an audience. Also, the switch 79 (FIG. 7) can be such that the output of the tape recorder 15 and the output of the FM receiver 76 are simultaneously applied to the input of the signal conditioner 78 on line 80, thus allowing the tape recorder and FM receiver signals to be mixed together or superimposed on one another. If desired, a mixer well known in the art can be coupled between line 80 and the receiver and recorder outputs to provide a controllable level of mixing.

A connection from the input to the U.A.R.T. 84 on line 83 to the input of the tape recorder 15 allows recording (on the same track as the signal generating the recorder output to switch 79, or if desired on a separate track) of the signal being reproduced by the receiver unit 11.

Utilizing the aforementioned tape recorder connections, in a manner well known in the audio recording and reproduction art, a number of additional features of the invention can be realized. For example, a performer can effectively play a "duet" by first recording a musical composition played by him on the keyboards 61, 63 with the tape recorder 15; and then replaying said composition through the receiver unit 11 via switch 79 while simultaneously playing a dubbed or superimposed melody live by wireless remote control through the keyboards 61, 63. In conjunction with the use of pause or editing controls incorporated in the recorder 15 in a manner well known in the audio art, this same technique can be used to edit or modify a previously recorded composition without the use of expensive studio facilities, thus enabling the creation of a high quality recording without the use of studio equipment, the studio being used only to transform the recorded digital information representing the composition to audio form.

Other audio recording/playback techniques known in the art may readily be utilized in conjunction with the system of my invention, as will be obvious to those skilled in the art.

We claim:

1. A remote control wireless keyboard musical instrument, comprising:

a musical device having a plurality of musical sound actuating elements, each element when actuated generating a corresponding musical sound;

a portable transmitter having a plurality of keys, each key corresponding to said actuating elements having an electrical switch coupled thereto and actuatable thereby;

electronic switching means for scanning said switches at a first relatively high rate of speed to ascertain which of said switches are actuated;

scan inhibiting means for temporarily interrupting the operation of said scanning means when an actuated switch is detected by said scanning means;

transmitting means coupled to said electronic switching means and responsive to said scan inhibiting means for causing the wireless transmission of a serial digital code identifying the key corresponding to said actuated switch, said code being transmitted at a second relatively low rate of speed;

means associated with said transmitting means for generating an end of transmission signal when the transmission of said code has been completed;

means responsive to said end of transmission signal for resetting said scan inhibiting means to enable said scanning means to resume operation;

a receiver for the wireless signals generated by said transmitter, said receiver reconstructing the serial code transmitted by said transmitter;

decoding means associated with said receiver for providing a plurality of separate output signals corresponding to respective ones of said portable transmitter keys and musical device sound actuating elements;

said receiver including impulse noise resistant error detecting means for providing an error signal indicative of the presence of an error in said reconstructed code;

signal gating means coupled to said decoding means and responsive to said error signal for inhibiting the generation of any of said output signals by said decoding means in response to a reconstructed code having an error therein; and means for coupling each output signal of said decoding means to a corresponding actuating element of said musical device, so that actuation of a given key of said portable transmitter results in actuation of the corresponding element of said musical device.

2. The musical instrument according to claim 1, wherein said musical device is a keyboard device.

3. The musical instrument according to claim 1, wherein said musical device is an electronic organ.

4. The musical instrument according to claim 1, wherein said musical device is a piano.

5. The musical instrument according to claim 1, wherein said code is a binary digital code including a parity bit, a start bit, a stop bit, and a check bit, said check bit always having a given value.

6. The musical instrument according to claim 1, further including dummy key signal generating means coupled to said scanning means for simulating an actuated transmitter key switch by generating a signal indicating the presence of a non-existent key of said transmitter, said dummy key signal resulting in the transmission of a corresponding serial code during each complete scan of the keys of said portable transmitter, said corresponding serial code modulating the output of said transmitter to establish a predetermined minimum frequency of the transmitted signal, thus limiting the required low frequency response of said receiver to said mimimum frequency.

7. The musical instrument according to claim 1, wherein said musical device has a number of auxiliary functions, each actuatable by an auxiliary function actuating element, and said portable transmitter has a corresponding number of auxiliary keys, each key having an electrical switch coupled thereto and actuatable thereby.

8. The musical instrument according to claim 7, wherein said scanning means scans one of said auxiliary key switches after completing each scan of said plurality of keys of said transmitter, said scanning means scanning different ones of said auxiliary key switches on successive scans.

9. The musical instrument according to claim 1, wherein said decoding means includes means for providing an output signal only when the corresponding reconstructed code is repeated within a predetermined time interval.

10. The musical instrument according to claim 1, wherein said musical device includes a group of elements which are most often actuated, and the least complicated of the codes transmitted by said transmitter correspond to respective ones of said group of elements.

11. The musical instrument according to claim 1, wherein the elements of said musical device include elements for generating the note of middle C (256 Hz) and harmonics and subharmonics thereof, the least complicated of the codes transmitted by said transmitter corresponding to said note of middle C and the next least complicated of said codes corresponding to said harmonics and subharmonics, codes of lesser complexity corresponding to notes harmonically closer to middle C.

12. The musical instrument according to claim 5, wherein said check bit is disposed adjacent said parity bit.

13. A remote control wireless keyboard musical instrument including means for providing reduced sensitivity to radiated impulse noise, comprising:

a portable transmitter having a plurality of keys;

a musical device remote from said transmitter for generating a separate musical sound corresponding to each of said keys;

encoding means associated with said transmitter for generating a digital serial code corresponding to each of said keys, said code being transmitted as electromagnetic signals by said transmitter only when the corresponding key is actuated;

said code including (i) a start bit, (ii) a stop bit, (iii) a parity bit, and (iv) a check bit, said start, stop and check bits having predetermined fixed values, said code further including a number of address bits defining the key corresponding to the code being transmitted, each of said bits occupying a predetermined time interval with respect to said start bit;

a receiver responsive to the electromagnetic signals radiated by said transmitter for reconstructing said digital serial code;

error detecting means associated with said receiver for detecting an error in said reconstructed code when (i) said check bit is of the wrong value, (ii) said stop bit is of the wrong value, (iii) said parity bit is of the wrong value, and (iv) a given set of address bits of said reconstructed code fails to be repeated within a predetermined time interval;

decoding means associated with said receiver for generating a separate output signal corresponding to each of said separate musical sounds;

signal gating means coupled to said error detecting means and said decoding means for precluding the generation of said output signal in response to an erroneous reconstructed code;

and coupling means for causing said musical device to generate one of said separate musical sounds when the corresponding output signal is generated by said decoding means.

14. The musical instrument according to claim 13, wherein said parity bit is disposed adjacent said check bit in said serial digital code.

15. The musical instrument according to claim 13, wherein said transmitter has a number of switches each defining an auxiliary function, said musical device has corresponding utilization means for each such auxiliary function, and a portion of said digital code comprises a number of address bits defining said function, said encoding means transmitting said code only when the corresponding switch is actuated, a code corresponding to only one of said switches being transmittable in conjunction with the transmission of codes corresponding to said plurality of keys, so that codes corresponding to said keys are transmittable more ofen than codes corresponding to said switches.

16. The musical instrument according to claim 13, wherein the structure of said code is such that the least complicated code structures correspond to harmonically related musical sounds.

17. The musical instrument according to claim 13, wherein the structure of said code is such that the least complicated code structures correspond to musical sounds of said musical device lying within one octave of the key of the musical sounds to be generated by said device.

18. A remote control wireless keyboard musical instrument, comprising:

a portable transmitter of electromagnetic carrier waves, said transmitter including means for modulating said waves in accordance with a predetermined digital code, said transmitter having a plurality of keys and a number of auxiliary switches;

a keyboard musical device remote from said transmitter for generating musical sounds, said device having a keyboard comprising a plurality of keys and a corresponding number of auxiliary functions corresponding to the keys and auxiliary switches of said transmitter respectively;

electronic switching means for scanning said transmitter keys and said auxiliary switches at a first relatively high rate of speed to ascertain which of said keys and switches are actuated, said switching means scanning less than all of said switches each time all of said keys are scanned, and scanning different switches on successive scans, so that more than one scan of all said keys corresponds to a single complete scan of all of said switches;

scan inhibiting means for temporarily interrupting the operation of said scanning means when an actuated one of said transmitter keys and switches is detected by said scanning means;

encoding means coupled to said scanning means and to said scan inhibiting means for generating a serial digital pulse train corresponding to a code identifying the actuated one of said transmitter keys and switches, and for causing said transmitter to modulate said carrier waves in accordance therewith, said pulse train being transmitted at a second relatively low rate of speed;

signal control means associated with said encoding means for generating an end of transmission signal for resetting sand scan inhibiting means to enable said scanning means to resume operation when the transmission of said pulse train has been completed;

a receiver for receiving, amplifying and demodulating the carrier waves radiated by said transmitter, said receiver including signal processing circuitry for reconstructing the pulse train generated by said encoding means;

error detection circuitry associated with said receiver for generating an error signal when an error appears in the digital code represented by said reconstructed pulse train;

decoding means coupled to said receiver for providing a plurality of output signals corresponding to said plurality of transmitter and musical device keys, and for providing a number of output signals corresponding to said number of transmitter switches and said number of musical device auxiliary functions;

signal inhibiting means for precluding the appearance of any of said output signals when there is an error in the corresponding digital code, said signal inhibiting means being coupled in circuit with said error detection means and said decoding means; and means for coupling said output signals of said decoding means to the corresponding keys and auxiliary functions of said keyboard musical device, so that when a key of said transmitter is actuated, the corresponding key of said musical device is actuated to cause a corresponding musical sound to be generated thereby, and so that when an auxiliary switch of said transmitter is actuated, the corresponding auxiliary function of said musical device is brought into operation.

19. The musical instrument according to claim 18, wherein said coupling means includes a frame dimensioned to be disposed adjacent the keyboard of said musical device, and a corresponding plurality of solenoids mounted on said frame, and means for mounting said frame adjacent said musical device keyboard, so that upon actuation of a given key of said transmitter keyboard, one of said solenoids actuates the corresponding key of said musical device keyboard.

20. The musical instrument according to claim 18, wherein said frame is detachably mounted to said musical device adjacent the keyboard thereof.

21. The musical instrument according to claim 18, wherein said digital code includes (i) a start bit, (ii) a stop bit separated from said start bit by a predetermined time interval, (iii) a parity bit, and (v) a number of address defining bits for identifying the particular one of said transmitter keys and auxiliary switches with respect to which said pulse train is being transmitted.

22. The musical instrument according to claim 21, wherein said digital code includes a check bit of a predetermined fixed value.

23. The musical instrument according to claim 22, wherein said check bit is disposed adjacent said parity bit in said pulse train.

24. The musical instrument according to claim 23, further including dummy key signal generating means coupled to said scanning means for causing said encoding means to generate a digital code corresponding to a non-existent key of said transmitter keyboard during each scan of the keys thereof, thereby to establish a predetermined minimum frequency for the signals modulating said carrier waves.

25. The musical instrument according to claim 24, wherein said decoding means includes data validation means for permitting an output signal to be generated thereby only when the corresponding reconstructed code is repeated within a predetermined time interval.

26. The musical instrument according to claim 25, wherein said digital code is such that the least complicated of the possible structures of said code corresponds to a musical sound containing the note of middle C, and the next least complicated structures of said code correspond to harmonics and subharmonics of said sound containing the note of middle C.

27. The musical instrument according to claim 25, wherein said digital code is such that the least complicated of the possible structures thereof and the next least complicated ones of said structures correspond to musical sounds lying within one octave of the key in which said composition is being played.

28. The musical instrument according to claim 1, further comprising means electrically coupled to said instrument for recording and reproducing said serial code.

29. The musical instrument according to claim 28, wherein said recording means is coupled to said transmitter for recording said code as the keys thereof are depressed, and wherein said reproducing means is coupled to said receiver for actuation of the elements of said musical device in accordance with the reproduced code.

30. The musical instrument according to claim 29, wherein said recording and reproducing means is capable of applying said reproduced code to said receiver simultaneously with the utilization of said wireless signals by said receiver to result in a composite code within said receiver corresponding to a mixing of said reconstructed code and said reproduced code, said composite code causing said elements of said musical device to be actuated in accordance therewith.

31. The musical instrument according to claim 30, wherein said recording and reproducing means is capable of recording said composite code at the same time said reproduced code is applied to said receiver by said reproducing means.

* * * * *